United States Patent [19]

Singheiser

[11] Patent Number: 4,973,445

[45] Date of Patent: Nov. 27, 1990

[54] HIGH-TEMPERATURE PROTECTIVE COATING

[75] Inventor: Lorenz Singheiser, Heidelberg, Fed. Rep. of Germany

[73] Assignee: Asea Brown Boveri Aktiengesellschaft, Mannheim, Fed. Rep. of Germany

[21] Appl. No.: 276,881

[22] Filed: Nov. 28, 1988

[30] Foreign Application Priority Data

Nov. 28, 1987 [DE] Fed. Rep. of Germany ..... 3740478

[51] Int. Cl.[5] ..... C22C 19/05

[52] U.S. Cl. ..... 420/443; 420/445; 428/679; 428/680

[58] Field of Search ..... 420/443, 445; 428/679, 428/680; 148/428

[56] References Cited

U.S. PATENT DOCUMENTS 4,312,682 1/1982 Herchenroeder ..... 420/443

*Primary Examiner*—R. Dean

[57] ABSTRACT

An alloy for coating austenitic super alloy materials for high-temperature service is provided. It comprises a nickel, chromium, aluminum alloy with at least one metal of Group IV and/or one transition metal of Group V of the periodic table as additives and yttrium, and/or hafnium included to improve adhesion of the alloy coating and of the aluminum oxide film formed thereon during heat treatment and intended high-temperature service.

3 Claims, No Drawings

HIGH-TEMPERATURE PROTECTIVE COATING

BACKGROUND OF THE INVENTION

1. Field of the Invention:

The invention relates to a high-temperature protective coating for austenitic materials and more particularly for alloys and components for such coatings.

2. Description of the Related Art:

High-temperature protective coatings of this type are used primarily for protecting the base material of structural elements made of heat-resistant steels and/or alloys that are used at temperatures over 600° C.

These high-temperature protective coatings are intended to retard or completely suppress the effects of high-temperature corrosion caused by sulfur, oil ash, oxygen, alkaline earths and vanadium. Such high-temperature protective coatings are preferably designed to be applied directly to the base material of the structural element to be protected.

High-temperature protective coatings are especially important in structural elements in gas turbines. They are applied to the rotor blades and guide blades and to those gas turbine segments where the heat tends to build up.

For the manufacture of these structural elements, an austenitic material based on nickel, cobalt or iron is preferably used. In the manufacture of gas turbine components, nickel superalloys are primarily used as the base material.

Until now structural elements intended for gas turbines have been conventionally provided with protective coatings formed from alloys having nickel, chromium, aluminum and yttrium as their essential components. Such high-temperature protective coatings have a matrix with an aluminum-containing phase embedded in it. When a structural component provided with such a high-temperature protective coating is exposed to an operating temperature of more than 950° C., the aluminum contained in the phase begins to diffuse to the surface, where it forms an aluminum oxide cove film.

A disadvantage here is that this aluminum oxide film does not have particularly good adhesion. It tends to wear off over time from corrosion, so that the resultant automatic protection for the high-temperature protective coating is lost. In the course of time, the corrosion becomes so extensive that the matrix of the high-temperature protective coating is itself attacked.

However, it has been found, all aspects considered, that structural elements of austenitic materials are best protected by such high-temperature protective coatings, and so these protective coatings cannot be dispensed with.

SUMMARY OF THE INVENTION

It is accordingly an object of the invention to provide a high-temperature protective coating, which overcomes the hereinafore-mentioned disadvantages of the heretofore-known coatings of this general type and that inherently adheres firmly to its substrate and furthermore is durable.

With the foregoing and other objects in view, there is provided, in accordance with the invention, a high-temperature protective alloy coating for austenitic structural components comprising an alloy that contains nickel, chromium, aluminum and yttrium and/or hafnium wherein at least one metal of Group IV and/or one transition metal of Group V of the periodic table, are additionally included in said alloy as additives.

The protective coating according to the invention is an oxide-dispersion-hardened alloy. It exhibits notably improved oxide stability, compared with previous high-temperature protective coatings. The high-temperature protective coating according to the invention has aluminum-containing phases that enable an adherent aluminum oxide-containing cover film to form.

If zirconium and silicon are additionally alloyed to the base material forming the high-temperature protective coating, then an additional aluminum-nickel-chromium oxide film forms on the aluminum-oxide-containing cover film. This additional film considerably increases the protection of the high-temperature protective coating and of the structural element located beneath it.

The formation of an aluminum oxide cover film can also be attained by adding silicon and tantalum. The high-temperature protective coating manufactured with one or the other additive according to this aspect of the invention has substantially better adhesion to the structural elements than previously known coatings of this type. This is also true for their cover films.

The firm, durable adhesion of the protective coating and its cover film is attained by means of the proportion of yttrium and/or hafnium which is especially required for the alloy. Under certain operating conditions, the addition of yttrium and/or hafnium has proved to provide particularly good adhesion of the coatings. It has also been found that when certain toxic substances act upon it, good adhesion is also attainable by means of hafnium alone.

Adding the yttrium in quantities from 0.2 to 2% by weight reduces the rate of oxidation in the surface of the high-temperature protective coating to an extent previously absent. This effect is even reinforced somewhat if hafnium is added. In a preferred embodiment, the high-temperature protective coating according to the invention is formed of an alloy that contains chromium, aluminum, nickel, yttrium, silicon and zirconium. Instead of yttrium, yttrium and hafnium, or hafnium alone, can also be used.

A preferred composition of this alloy has 25 to 27% by weight of chromium, 4 to 7% by weight of aluminum, 0.2 to 2% by weight of yttrium, 1 to 3% by weight of silicon and 1 to 2% by weight of zirconium, the remaining portion of the alloy being nickel. The 0.2 to 2% by weight of yttrium may also replaced by 0.2 to 2% by weight mixture of yttrium and hafnium, or by 0.2 to 2% by weight of hafnium.

A high-temperature protective coating having the same properties is attained by the use of an alloy that contains chromium, aluminum, yttrium, nickel, silicon and tantalum. Once again, the yttrium portion can be replaced by yttrium and hafnium, or by hafnium alone. Preferably, an alloy is used that contains 23 to 27% by weight of chromium, 3 to 5% by weight of aluminum, 0.2 to 2% by weight of yttrium, 1 to 3.0% by weight of silicon, and 1 to 3% by weight of tantalum, the remaining portion of the alloy comprising nickel. The 0.2 to 2% by weight of yttrium can also replaced by 0.2 to 2% by weight of yttrium and hafnium, or by 0.2 to 2% by weight of hafnium.

All percentages by weight herein relate to the total weight of the particular alloy.

All the alloys described here are equally suitable for forming a high-temperature protective coating. No matter what these alloys described above they are made of, under operating conditions, aluminum oxide cover films form on these protective coatings, and in each case the cover films form equally quickly and with a substantially equal thickness from each of the alloy compositions according to the invention; they do not wear off even at temperatures higher than 950° C.

Other features which are considered as characteristic for the invention are set forth in the appended claims.

Although the invention is illustrated and described herein as embodied in a high-temperature protective coating, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific examples.

EXAMPLE

The invention will now be described in further detail in terms of an exemplary embodiment, which describes the manufacture of an alloy coated gas turbine component. The gas turbine component to be coated is manufactured from an austenitic material, in particular a nickel superalloy. Prior to the coating, the nickel superalloy component is first cleaned chemically and then roughened by sandblasting. The coating of the component then takes place in a vacuum by means of plasma spraying.

For the coating, an alloy is used that has 25 to 27% by weight of chromium, 4 to 7% by weight of aluminum, 0.2 to 2% by weight of yttrium, 1 to 3% by weight of silicon and 1 to 2% by weight of zirconium. The remaining portion of the alloy comprises nickel.

The 0.2 to 2% by weight of yttrium can also replaced by 0.2 to 2% by weight of yttrium and hafnium, or by 0.2 to 2% by weight of hafnium.

Instead of this alloy, an alloy can also be used that contains 23 to 27% by weight of chromium, 3 to 5% by weight of aluminum, 0.2 to 2% by weight of yttrium, 1 to 3.0% by weight of silicon, and 0.1 to 3% by weight of tantalum, the remaining portion of the alloy being nickel. The 0.2 to 2% by weight of yttrium can also replaced by 0.2 to 2% by weight of yttrium and hafnium, or by 0.2 to 2% by weight of hafnium alone.

All the percentages by weight relate to the total weight of the coating alloy used.

The material forming the protecting coating alloy is present in powder form, and preferably has a particle size of 45 μm. Prior to the application of the high-temperature protective coating, and in particular prior to the application of the alloy forming the protective coating, the nickel superalloy structural component is heated with the aid of the plasma to 800° C. The coating alloy is applied directly to the superalloy base material of the component. Argon and hydrogen are used as the plasma gas. After the application of the coating alloy, the coated structural component is subjected to a heat treatment. This is done in a high-vacuum annealing furnace. A pressure of less than $5\times10^{-3}$ Torr is maintained in the furnace. Once the vacuum is attained, the furnace is heated to a temperature of 1100° C. The above-indicated temperature is maintained for approximately one hour, with a tolerance of approximately ±4° C.

Next, the heating of the furnace is discontinued, and the coated and heat-treated structural component is slowly cooled in the furnace. Its manufacture is complete once the cooling down is finished All the variant alloys are applied in the same manner.

The foregoing is a description corresponding in substance to German Application No. P 37 40 478.4, dated Nov. 28, 1987, the International priority of which is being claimed for the instant application, and which is hereby made part of this application. Any material discrepancies between the foregoing specification and the aforementioned corresponding German application are to be resolved in favor of the latter.

I claim:

1. A high-temperature protective alloy coating for austenitic structural components consisting essentially of a base material of nickel, chromium, aluminum and yttrium and comprising 25 to 27% by weight of chromium, 4 to 7% by weight of aluminum, 0.2 to 2% by weight of yttrium; and 1 to 3% by weight of silicon and 1 to 2% by weight of zirconium as additives of the total weight of the alloy, the remaining portion of the alloy consisting essentially of nickel.

2. A high-temperature protective alloy coating for austenitic structural components consisting essentially of a base material of nickel, chromium, aluminum and hafnium comprising 25 to 27% by weight of chromium, 4 to 7% by weight of aluminum, 0.2 to 2% by weight of hafnium; and 1 to 3% by weight of silicon and 1 to 2% by weight of zirconium as additives of the total weight of the alloy, the remaining portion of the alloy consisting essentially of nickel.

3. A high-temperature protective alloy coating for austenitic structural components consisting essentially of a base material of nickel, chromium, aluminum and yttrium or hafnium and comprising about between 25 to 27% by weight of chromium, 4 to 7% by weight of aluminium, 0.2 to 2% by weight of yttrium or hafnium; and 1 to 3% by weight of silicon and 1 to 2% by weight of zirconium as additives of the total weight of the alloy, the remaining portion of the alloy consisting essentially of nickel.

* * * * *